US010062502B2

(12) United States Patent
Hamberger

(10) Patent No.: US 10,062,502 B2
(45) Date of Patent: Aug. 28, 2018

(54) CIRCUIT ARRANGEMENT FOR COMPENSATION OF A DC COMPONENT IN A TRANSFORMER

(71) Applicant: Siemens Aktiengesellschaft, Munich (DE)

(72) Inventor: Peter Hamberger, Kirchschlag bei Linz (AT)

(73) Assignee: Siemens AG Österreich, Vienna (AT)

( * ) Notice: Subject to any disclaimer, the term of this patent is extended or adjusted under 35 U.S.C. 154(b) by 0 days.

(21) Appl. No.: 15/372,507

(22) Filed: Dec. 8, 2016

(65) Prior Publication Data

US 2017/0169940 A1 Jun. 15, 2017

(30) Foreign Application Priority Data

Dec. 9, 2015 (EP) ..... 15198567

(51) Int. Cl.

| | |
|---|---|
| ***G05F 7/00*** | (2006.01) |
| ***H01F 27/42*** | (2006.01) |
| ***G05F 3/08*** | (2006.01) |
| ***H01F 27/245*** | (2006.01) |

(52) U.S. Cl.

CPC ..... *H01F 27/42* (2013.01); *G05F 3/08* (2013.01); *H01F 27/245* (2013.01)

(58) Field of Classification Search

CPC ... G05F 7/00; G05F 1/32; H01F 27/38; H01F 2029/143; G01R 15/202

USPC ..... 323/22, 224, 232, 235, 237, 248, 249, 323/356; 324/144, 253, 260; 361/157, 361/146, 143

See application file for complete search history.

(56) References Cited

U.S. PATENT DOCUMENTS

| | | | | |
|---|---|---|---|---|
| 3,122,699 | A * | 2/1964 | Schohan | G05F 1/32 323/232 |
| 5,694,030 | A * | 12/1997 | Sato | G05F 1/575 323/282 |
| 7,567,160 | B2 * | 7/2009 | Folts | H01F 27/085 336/55 |
| 9,030,119 | B2 * | 5/2015 | Jin | H05B 33/0827 315/185 R |
| 2005/0194944 | A1 * | 9/2005 | Folts | H02J 3/1828 323/209 |

(Continued)

FOREIGN PATENT DOCUMENTS

| | | |
|---|---|---|
| CN | 1625010 | 6/2005 |
| CN | 101383500 | 3/2009 |
| CN | 102148503 | 8/2011 |

(Continued)

*Primary Examiner* — Rajnikant Patel
(74) *Attorney, Agent, or Firm* — Cozen O'Connor

(57) ABSTRACT

A circuit arrangement for compensation of a DC component in a transformer, wherein the transformer includes a winding arrangement connected via connecting lines to a power system for transporting electrical energy, and includes a neutral point connected to earth, where the circuit arrangement includes a transductor circuit arranged in a current path that connects a connection point situated on a node-free portion of the connection line to earth, a control and regulation device that controls the transductor circuit via a control signal and to which is fed, on the input side, a signal provided by a detection device with respect to a size and direction of the DC component to be compensated.

19 Claims, 2 Drawing Sheets

(56) References Cited

U.S. PATENT DOCUMENTS

| | | | | |
|---|---|---|---|---|
| 2010/0156394 | A1* | 6/2010 | Ausserlechner ..... | G01R 15/202<br>324/144 |
| 2013/0201592 | A1* | 8/2013 | Hamberger ..... | H01F 27/38<br>361/157 |

FOREIGN PATENT DOCUMENTS

| | | | |
|---|---|---|---|
| CN | 203481793 | U | 3/2014 |
| CN | 103943340 | A | 7/2014 |
| DE | 36 31 438 | A1 | 3/1988 |
| EP | 2 622 614 | | 8/2013 |
| WO | WO 2004/013951 | A2 | 2/2004 |
| WO | WO 2011/127969 | | 10/2011 |
| WO | WO 2012/041368 | | 4/2012 |
| WO | WO 2015/086048 | A1 | 6/2015 |

* cited by examiner

CIRCUIT ARRANGEMENT FOR COMPENSATION OF A DC COMPONENT IN A TRANSFORMER

BACKGROUND OF THE INVENTION

1. Field of the Invention

The invention generally relates to electrical transformers as used in power systems for the generation, transmission and distribution of electrical energy and, more particularly, to a circuit arrangement for compensation of a DC component in a transformer, where the transformer includes a winding arrangement that is connected via connecting lines to the power system and includes a neutral point connected to earth.

2. Description of the Related Art

In power systems for the generation, transmission and distribution of electrical energy, for a variety of reasons, a DC current that is proportionately overlaid on the alternating current can form. A direct current component of this type, hereinafter known as a DC component can be created, for example, by a power converter connected to the power system, or can be a "geomagnetically induced current" (GIC).

A GIC is caused by solar wind in that the Earth's magnetic field changes so that in a conductor loop constituting network lines and earth return conductors, a flux change occurs and the electrical voltage induced therein generates the GIC. The GIC is time and direction-dependent. However, the speed at which the GIC changes is so relatively slow that it can be regarded as a DC component in the power system.

Regardless of its cause, a DC component in a transformer is always undesirable because a magnetic unidirectional flux portion is associated with it, which becomes overlaid on the alternating flux in the core of the transformer, so that the output of the transformer core is no longer symmetrical. A displacement of the operating point of the magnetic material occurs. Depending on the design of the transformer, even a very small DC component of a few 100 mA can increase the emission of operating noise by 10 to 20 dB. The displacement of the operating point of the magnetic material can lead to a significant increase in the losses in the region of 20-30%. Locally, increased heating can arise in the transformer, so that the lifespan of the insulation of the electrical winding can be impaired. In the case of a large GIC, hotspots can form on metallic parts and lead to the degradation of the insulating liquid, which can result in the formation of decomposition gases.

Various methods and devices are known for reducing a unidirectional flux portion in the core of a transformer. For example, in EP 2 622 614 B1, it is proposed to provide the transformer core with a compensation winding and, via a semiconductor switching device, to feed thereinto a compensation current the effect of which is directed contrary to the disruptive unidirectional flux portion. The advantage herein is that this compensation winding is galvanically separated from the energy network, i.e., has no connection to the primary or secondary winding system of the transformer.

A compensation winding of this type can now be realized at a reasonable cost if it is provided during the production of the transformer. Depending on the size of the DC component to be compensated, a correspondingly dimensioned installation space is to be provided, so that the dimensions of the transformer core change.

Compared with this, a retrofitting is far more effort and barely of any practical importance. If a transformer that is already in use is to be retrofitted with a DC compensation, then the transformer must be removed from the power system and the compensation winding must be installed in the interior of the transformer tank. A retrospective installation of a compensation winding is often not at all possible. In any event, the costs of a subsequent installation are very high so that, to date, retrofitting has hardly ever been performed.

Restrictions also result from the limit load of available semiconductor components. In transformers that are used as part of a high voltage DC transmission system, an induced voltage of several 1000 V can be induced in a compensation winding. A GIC can also reach a current strength of more than 50 A, as a result of which the technical implementation of the circuit is difficult.

The arrangement of semiconductor components with a limited lifespan in the interior of a power transformer or a distribution transformer that is configured for fault-free operation over several decades is also problematic.

SUMMARY OF THE INVENTION

It is an object of the present invention to provide as simple and robust an approach as possible for the compensation of a DC component, which can also be realized economically with transformers already in operation and which also leads to expectations of a long service life and a high level of reliability.

This and other objects and advantages are achieved in accordance with the invention by a circuit arrangement in which the compensation of a DC component is not brought about by components in the interior of the transformer, but rather—similarly to a protective device—outside the transformer housing, where a separate compensation winding is not necessary.

Starting from a transformer, the winding arrangement of which is connected via connecting lines on the supply side to a power system for transporting electrical energy and having a neutral point connected to earth. The circuit arrangement comprises a transductor circuit arranged in a current path that connects a connection point situated on a node-free portion of the connection line to earth, and a control and regulation device that controls the transductor circuit via a control signal, to which is fed, on the input side, a signal provided by a detection device concerning the size and direction of the DC component to be compensated.

The transductor circuit functions as a magnetic switch. The function of a transductor is known per se, and need not be described further here. It is advantageous that the transductor circuit has no actively functioning components, such as controlled semiconductor valves, but only passively functioning components. These components are arranged in a current path that connects to earth a node-free portion of each feed line to the transformer. The transductor circuit is controlled by a control unit to which an item of information concerning the size and direction of the DC component to be compensated is fed. Such an information item can originate, for example, from a sensor in the interior of the transformer, for example, a magnetic field sensor that measures the disruptive unidirectional flux portion in the core of the transformer, or is alternatively obtained from the power system, for example, by measuring the DC component in a network line (although this is technically complex due to the greatly differing sizes of the supply current and the DC component). Also conceivable are other measuring devices installed in the power system that detect or predict a GIC.

The technical effect achieved with the circuit arrangement in accordance with the invention resembles that of a set of "DC points" which acts as a protective device. The disruptive DC portion is "conducted away" to earth through targeted control of the transductor circuit arranged in the current path between the transformer feed line and earth. Thus, the DC portion is counteracted in advance so that it does not reach the transformer (at least not to its full extent). For this "compensation" that occurs as early as the feed line, a separate compensation winding magnetically coupled to the transformer core, as is otherwise usual for this purpose, is no longer necessary. With the present circuit arrangement, a DC portion even of more than 50 A, such as a large GIC, can be controlled in an easy manner. Both are highly advantageous. In contrast thereto, however, is the requirement that the circuit arrangement with all the components lying in the transductor current path must be configured according to the voltage level of the transformer supply line, such as 20 kV or 120 kV or more. However, the above-mentioned advantages outweigh this additional effort.

As previously stated, the components that conduct away a DC component are arranged outside the transformer housing. They function purely passively. Maintenance is readily possible. The reliability of the circuit arrangement is high.

In place of the power electronics components (e.g., thyristors) that are otherwise usual, for the generation of a compensation current, an "inductively acting switch", a transductor circuit, is used. The components of a transductor circuit, magnetic coils and uncontrolled valves, lead to the expectation of a long lifespan and trouble-free operation over many years. On the part of the network operator, therefore, the level of acceptability of a transformer with a DC compensation device of this type is high.

In a preferred embodiment, the circuit arrangement is configured as a transductor circuit with two parallel current branches. In each of these current branches, therefore, a transductor load winding and, in series therewith, an uncontrolled valve are respectively provided. The current flow direction of the two valves is opposed. Each load winding is magnetically coupled via a saturatable transductor core to a transductor control winding, where a control signal is fed to the control winding. The saturation state of the transductor core and thus the switching state of the "magnetic valve" are pre-settable via the control signal. In conjunction with the opposed arrangement of the valves, it is achieved that, depending on the current direction, a mirror-inverted DC compensation is set against a DC component.

An embodiment that is more cost-efficient relative thereto can be constructed so that the transductor circuit has a single load winding that is arranged in series with a single valve and a switching device for reverse-poling of the current flow direction of the valve. Here, this load winding of the transductor circuit is also coupled via a soft magnetic transductor core to a control winding. A control signal, the information of which is provided by a detection device that detects the size and direction of the DC component to be compensated, is fed into the control winding. Herein, by reverse-poling this single valve, the compensation of a DC portion in both directions is possible.

In order to reduce the production costs, it may be favorable for both of these embodiments if the transductor core is configured as a slit strip core.

In order to keep the control power required for controlling the transductor circuit as low as possible, it can be advantageous if the slit strip core is made of sheet metal lamellae of a soft magnetic material which has an essentially narrow rectangular hysteresis loop. The control and regulation device can thus be constructed simpler.

A further reduction of the control power can be thereby achieved by arranging the transductor core in a magnetic circuit that has at least one air gap. This results in an inclination of the hysteresis loop so that the magnetic flux density is limited to less than/equal to 20% of the saturation flux density.

Particularly favorable can be a circuit arrangement in which the detection device that detects the size and direction of the disruptive DC portion is configured as a magnetic field measuring device. Such a magnetic field measuring device can be arranged in the interior of the tank lying on the transformer core. In this way, just one signal strand is fed out of the interior of the transformer tank (to the control and regulation device), but not a power strand. A retrofit can be realized at relatively little cost.

PCT/EP2010/054857 discloses a magnetic measuring device. Here, the measuring device has a C-shaped shunt component, the limbs of which are directed toward the core of the transformer so that a magnetic partial flux is diverted therefrom. The diverted partial flux induces an electrical voltage, which represents the unidirectional flux portion to be compensated in the core, as the signal in a sensor coil provided at the shunt component.

In other words, the present solution approach enables a transformer in operation in the power system to be equipped retrospectively in a simple and economical manner with the functionality of a DC protection system. Not a compensation winding, but only a measuring device must be installed in the transformer housing, provided the information concerning the DC portion to be compensated does not come from another detection device. Thus, in transformers already in operation, the installation of a DC compensation with relatively little effort is also possible retrospectively. Until now, a retrofitting of this type has been barely justifiable for cost reasons.

It appears favorable if each diode is configured as a high-blocking power diode that has a high blocking ability and a low forward resistance. This can be achieved with a construction type of a diode, where a thin low doped intermediate layer is formed between the highly doped pn zones.

In order to limit the electric current in the conductive state of the transductor, it can be favorable if a current-limiting reactor, arranged in series with the load winding of the transductor circuit, is arranged in the current path (power branch). This current limiting reactor can be configured like a "shunt reactor" for comparatively low current and low power. The control and regulation device can thus be constructed simpler because the effort for safety technology otherwise to be provided is lower.

In an alternative thereto, it can also be advantageous, however, if each of the parallel-connected load windings or the single load winding of the transductor circuit device is configured for current limitation in the current path. A separate current limiting reactor is then not required. Herein, the control and regulation device can also be constructed a simpler manner.

It is also an object of the invention to provide a method for compensating for a DC component in a winding arrangement of a transformer, where the winding arrangement is connected via connecting lines to a power system for transporting electrical energy and where a circuit arrangement described in detail above is used.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

For further explanation of the invention, reference will be made in the following section of the description to drawings which illustrate further advantageous embodiments, details and developments of the invention, using a non-limiting exemplary embodiment, in which.

DETAILED DESCRIPTION OF THE EXEMPLARY EMBODIMENTS

Figure 1:
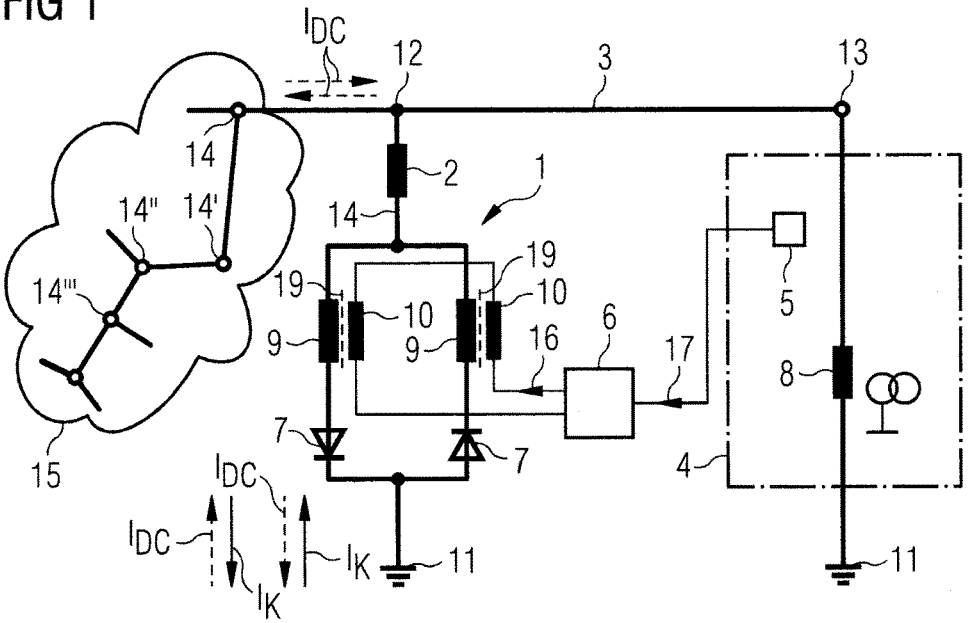
FIG. 1 shows a simplified circuit diagram of a circuit arrangement according to a first embodiment of the invention.

FIG. 1 shows a simplified circuit diagram of a first embodiment of the inventive circuit arrangement. The circuit consists essentially of a transductor circuit 1 arranged in a current path 20. The current path 20 connects a connection point 12, which lies on a feed line 3 to the transformer 4, to earth potential 11. For the sake of simplicity, in FIG. 1 only one of the feed lines 3 is shown, representing the three strands of the 3-phase system. Also for the sake of simplicity, only one winding 8 of the winding system of the transformer 4 is represented. The neutral point of the transformer 4 is earthed, i.e., connected to the earth point 11. Both the feed lines 3 and the current path 20 are also emphasized schematically by a bold line style (power path); in FIGS. 1 and 2, the conduction of the measurement signal 17 and the control signals 16 (measurement and control signal paths) are represented with a thin line style.

In the example in FIG. 1, the transformer is a distribution transformer at the interface between a high voltage power system and a medium voltage system. Normally, such distribution transformers are implemented in the vector group Yy0, i.e., with earthed neutral point. Urban network distribution transformers also typically have an accessible neutral point, such as in the vector group Yz5.

The connection point 12 lies on a feed line portion 31 between a connection node point 14 and a transformer connection 13. The node point 14 is part of a power system 15 for the generation, transmission and distribution of electrical energy that also comprises further node points 14', 14", 14'". No further network nodes are arranged between the connection network node 14 and the transformer connection 13, i.e., the portion 31 of the three-phase conductor system 3 is node-free.

It is assumed that a DC component ($I_{DC}$) flows in the feed lines 3 (represented in FIG. 1 by a double arrow). The current flow direction of the DC component ($I_{DC}$) is directed toward or away from the transformer. As already disclosed, this DC component is highly undesirable for the transformer 4. In accordance with the present invention, this DC component is already counteracted before entry into the transformer 4. Similarly to a set of points, the DC component is diverted to earth 11, so that it cannot develop its disruptive effect in the core of the transformer. In contrast to conventional DC compensation methodologies in which a compensation winding in the interior of the transformer housing is assumed, no separate compensation winding is herein required. Rather, the DC current is diverted at the feed line. This diversion is brought about essentially by a transductor circuit 1 that acts like a protective device for the transformer.

The transductor circuit 1 functions as a magnetic switch or "magnetic valve" and is controlled by a control and regulation unit 6. In the conductive state, the current limitation occurs via a choke 2 that is arranged in a series connection with the transductor circuit 1. The control and regulation unit 6 comprises a computer unit with an algorithm able to execute thereon. This generates the control signal 16, where the measurement signal 17 fed in on the input side is used. The measurement signal 17 is a representation of the DC component to be compensated and is provided by a magnetic field sensor 5. This magnetic field sensor 5 is arranged in the interior of the transformer 4, where it measures a unidirectional flux portion flowing in the core of the transformer and originating from the DC component. PCT/EP2010/054857 describes one type of a magnetic field sensor.

The transductor circuit 1 also enables the compensation of comparatively high GIC DC currents, which can amount to more than 50 A. In the embodiment shown in FIG. 1, the transductor circuit 1 consists of two parallel current paths in each of which a transductor load winding 9 and a diode 7 are arranged in series. The two diodes 7 in the parallel paths are arranged antiparallel (the conducting direction is opposed), which means that in the representation of FIG. 1, the diode 7 in the left branch points toward earth 11 and in the right branch, the diode 7 points toward the feed line 3. Each load winding 9 in the parallel branches is magnetically coupled via a saturation-capable transductor core 19 to an associated transductor control winding 10. The two control windings 10 are arranged in series behind one another in a control circuit. The control signal 16 is fed into the control circuit so that the saturation state of the transductor core 19 and thus the current flow in the current path 20 is pre-settable. Depending on the control signal 16, it can be achieved that a compensation current $I_K$ forms in the current path 20 (power path) in one or the other direction (either from the connection point 12 in the direction of earth 11 or vice versa). With this bidirectional compensation current $I_K$ (mixed current with harmonics) in the current path 20, the disruptive unidirectional flux portion in the core of the transformer is counteracted or fully compensated. In the representation of FIG. 1, the complete DC compensation is represented, in each case, through two equal-sized arrows, i.e., an equal-sized DC component $I_{DC}$ (dashed arrow) is directed contrary to each compensation current $I_K$ (continuous arrow).

Figure 2:
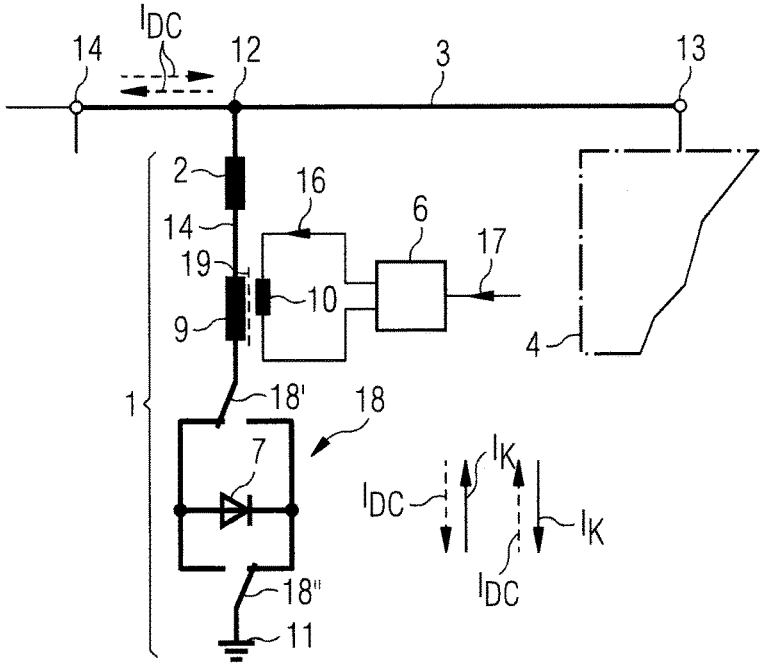
FIG. 2 shows a simplified circuit diagram of a circuit arrangement according to a second embodiment of the invention.

FIG. 2 shows a differently configured solution approach. In contrast to FIG. 1, the transductor circuit 1 does not consist herein of two transductor load windings, but consists of a single load winding 9 and a transductor control winding 10 associated therewith. The load winding 9 and the control winding 10 are again magnetically coupled via a saturation-capable transductor core 19. The control winding 10 is arranged in a control circuit into which the control signal 16 is fed. (The control circuit is illustrated in FIG. 2 with a thin line style). The control signal 16 is again provided by a control and regulation unit 6 on its output side. On the input side, the measurement signal 17 is fed to this control and regulation unit 6 so that in this embodiment of the invention, the information regarding the size and direction of the DC component to be compensated is present in the control and regulation unit 6. The control signal 16 renders the saturation state of the transductor core 19 such that the inductively operating switch 1 is made conductive in a suitable manner, by which the current flow in the current path 20 is presettable (harmonic-laden current, mirror-inverted relative to $I_{DC}$).

Arranged in series with the load winding 9 is a switching device 18 that includes a first switch contact 18' and a second switch contact 18". Arranged between these switch contacts 18', 18" is a single diode 7. In the switching position shown, the first switch contact 18' is connected to the anode of the diode 7, and the second switch contact 18" to the cathode. Depending on the switching position of these two switch contacts 18', 18", the polarity of the diode 7 can be reversed. Thus, also in this circuit embodiment, where only a single uncontrolled valve 7 is used, a bidirectional compensation of a DC component is possible. (See double arrow in FIG. 2).

The actuation of the switching device 18 can occur in different ways, such as through an actuator or a motor, and manual operation is also conceivable.

Again, for the sake of clarity, the reference numeral 3 in FIG. 2 represents just one line of the 3-phase system. The portion 31 of the lines 3 again lies between a network node 14 of an energy supply network 15 and a connection point 13 of the transformer 4. Between these two points, the feed line portion 31 to the transformer 4 is node-free. The circuit arrangement 1 is situated in proximity to the transformer 4, such as in a transformer station.

In FIGS. 1 and 2, the same reference numerals denote identical or functionally similar elements. Both in the embodiment of FIG. 1 and also in the embodiment of FIG. 2, a current limiting choke 2 is shown in the current path 20. It is also possible, however, that the two load windings 9 or the one load winding 9 is/are configured such that in the conductive state of the "magnetic valve", the electrical current in the current path 20 is limited.

In the two embodiments, the DC protective effect occurs according to the principle of DC points directly at the feed line, i.e. the compensation current $I_K$ need only have the mirror-inverted size of the disruptive DC current on the line 31.

It is herein particularly advantageous that with the present circuit arrangement, large currents of over 50 A, as can occur with GIC, can also be counteracted.

Both embodiments have the essential advantage that the installation of a compensation winding is not necessary either subsequently in the context of a retrofit or during the production of the transformer.

For a transformer already in operation, the substantial advantage results that for the first time, a DC protection/DC compensation is realizable at a reasonable cost.

During the production of a transformer, the installation space that would otherwise be required for the compensation winding is dispensed with. This results in a compact design. This is particularly advantageous if large GIC currents are to be compensated because, in this case, the compensation winding is relatively voluminous and a correspondingly large installation space has to be provided.

The circuit arrangement has no active power electronics, but only passively acting components. As a result, the circuit arrangement, can easily be dimensioned for large voltages. The inductive switch 1 is, in principle, a transformer in no-load operation, where the entire voltage (110 kV, 220 kV, 340 kV, etc.) drops to ground. It can be realized with relatively little cost. The other components are common in transformer design or are commercially available.

Although the invention has been illustrated and described in detail based on the two preferred exemplary embodiments, the invention is not restricted by the examples given and other variations can be derived therefrom by a person skilled in the art without departing from the protective scope of the invention.

Figure 3:
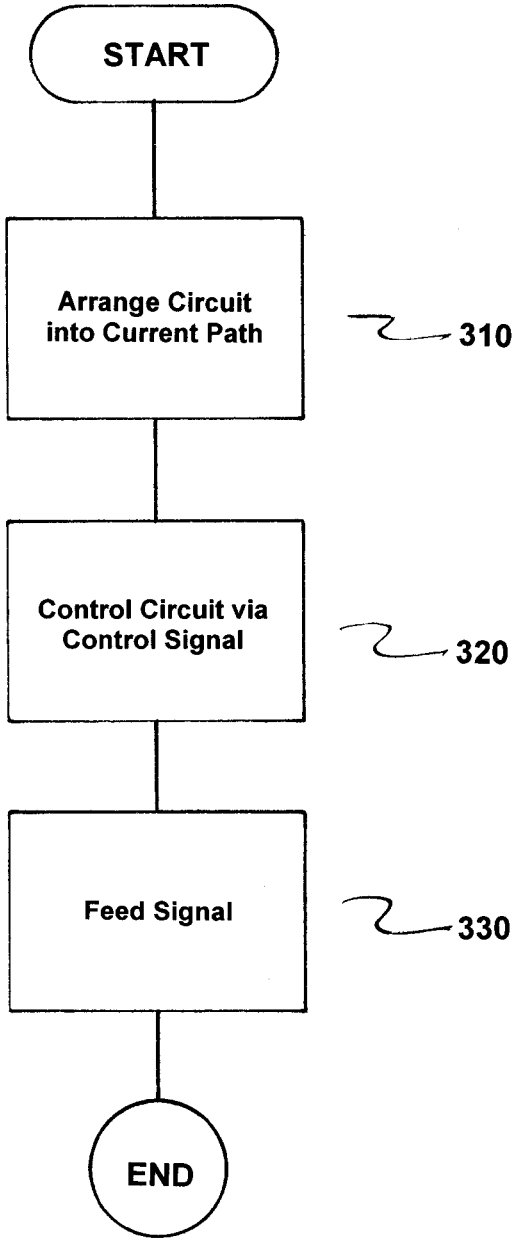
FIG. 3 is a flowchart of the method in accordance with the invention.

FIG. 3 is a flowchart of a method for compensating for a DC component ($I_{DC}$) in a winding arrangement (8) of a transformer (4), where the winding arrangement (8) is connected via connecting lines (3) to a power system (15) for transporting electrical energy, and where the winding arrangement (8) includes a neutral point connected to earth (11). The method comprises arranging a transductor circuit (1) in a current path (20) which connects a connection point (12) situated on a node-free portion (31) of the connection line (3) to earth (11), as indicated in step 310.

Next, a control and regulation device (6) controls the transductor circuit (1) via a control signal (16), as indicated in step 320. Next, a signal (17) with respect to a size and direction of the DC component ($I_{DC}$) to be compensated is fed on an input side of the control and regulation device (6) by a detection device (5), as indicate in step 330.

While there have been shown, described and pointed out fundamental novel features of the invention as applied to a preferred embodiment thereof, it will be understood that various omissions and substitutions and changes in the form and details of the methods described and the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A circuit arrangement for compensation of a DC component in a transformer including a winding arrangement connected via connecting lines to a power system for transporting electrical energy, and including a neutral point connected to earth, comprising:

a transductor circuit arranged in a current path which connects a connection point situated on a node-free portion of the connection line to earth;

a control and regulation device which controls the transductor circuit via a control signal; and a detection device, which feeds a signal with respect to a size and direction of the DC component to be compensated, on an input side of the control and regulation device.

2. The circuit arrangement as claimed in claim 1, further comprising:

includes a load winding and an uncontrolled valve arranged in each respective branch of two parallel current branches of the transductor circuit;

wherein each uncontrolled valve is connected antiparallel;

wherein each load winding is magnetically coupled to an associated control winding via a transductor core; and wherein the control signal is fed to the control winding.

3. The circuit arrangement as claimed in claim 1, wherein the transductor circuit includes a single load winding which is arranged in series with a switching device for reverse-poling a current flow direction of a single valve; and wherein the single load winding is magnetically coupled to an associated control winding via a transductor core.

4. The circuit arrangement as claimed in claim 1, wherein the transductor core is configured as a slit strip core.

5. The circuit arrangement as claimed in claim 2, wherein the transductor core is configured as a slit strip core.

6. The circuit arrangement as claimed in claim 3, wherein the transductor core is configured as a slit strip core.

7. The circuit arrangement as claimed in claim 4, wherein the slit strip core is made from sheet metal lamellae of a soft magnetic material which has an essentially narrow rectangular hysteresis loop.

8. The circuit arrangement as claimed in claim 7, wherein the transductor core is arranged in a magnetic circuit which has at least one air gap, such that a magnetic flux density is limited to less than or equal to 20% of a saturation flux density.

9. The circuit arrangement as claimed in claim 1, wherein the detection device is a magnetic field measuring device which is arranged on a core of the transformer to measure a magnetic unidirectional flux portion caused in the core by the DC component.

10. The circuit arrangement as claimed in claim 2, wherein the detection device is a magnetic field measuring device which is arranged on a core of the transformer to measure a magnetic unidirectional flux portion caused in the core by the DC component.

11. The circuit arrangement as claimed in claim 3, wherein the detection device is a magnetic field measuring device which is arranged on a core of the transformer to measure a magnetic unidirectional flux portion caused in the core by the DC component.

12. The circuit arrangement as claimed in claim 9, wherein the detection device comprises a shunt component which diverts a magnetic partial flux from the core of the transformer, such that an electrical voltage is induced in a sensor coil provided at the shunt component, by which a measurement signal is formed.

13. The circuit arrangement as claimed in claim 2, wherein one of (i) each uncontrolled valve arranged in each respective branch of the two parallel current branches of the transductor circuit and (ii) the single valve is configured as a high-blocking power diode.

14. The circuit arrangement as claimed in claim 3, wherein one of (i) each uncontrolled valve arranged in each respective branch of the two parallel current branches of the transductor circuit and (ii) the single valve is configured as a high-blocking power diode.

15. The circuit arrangement as claimed in claim 2, further comprising:

a current-limiting reactor arranged in a current path in series with the transductor circuit.

16. The circuit arrangement as claimed in claim 3, further comprising:

a current-limiting reactor arranged in a current path in series with the transductor circuit.

17. The circuit arrangement as claimed in claim 2, wherein one of (i) each of the two parallel-connected load windings and (ii) a single load winding is configured for current limitation in a current path.

18. The circuit arrangement as claimed in claim 3, wherein one of (i) each of the two parallel-connected load windings and (ii) a single load winding is configured for current limitation in a current path.

19. A method for compensating for a DC component in a winding arrangement of a transformer, the winding arrangement being connected via connecting lines to a power system for transporting electrical energy, the winding arrangement having a neutral point connected to earth, the method comprising:

arranging a transductor circuit in a current path which connects a connection point situated on a node-free portion of the connection line to earth;

controlling, by a control and regulation device, the transductor circuit via a control signal; and feeding, by a detection device, a signal with respect to a size and direction of the DC component to be compensated, on an input side of the control and regulation device.

* * * * *